US009656833B2

(12) United States Patent
Bauck et al.

(10) Patent No.: US 9,656,833 B2
(45) Date of Patent: May 23, 2017

(54) MODULAR DIRECT DRIVE SYSTEM FOR POWERED HOSE REELS

(71) Applicant: Graco Minnesota Inc., Minneapolis, MN (US)

(72) Inventors: Mark L. Bauck, Coon Rapids, MN (US); Michael E. Bloom, Anoka, MN (US); Daniel J. Rogers, Lindstrom, MN (US); Anthony J. Kuschel, Plymouth, MN (US); Daniel L. Medina, St. Paul, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 14/895,839

(22) PCT Filed: Jun. 12, 2014

(86) PCT No.: PCT/US2014/042097

§ 371 (c)(1),
(2) Date: Dec. 3, 2015

(87) PCT Pub. No.: WO2014/201233

PCT Pub. Date: Dec. 18, 2014

(65) Prior Publication Data

US 2016/0122155 A1 May 5, 2016

Related U.S. Application Data

(60) Provisional application No. 61/834,197, filed on Jun. 12, 2013.

(51) Int. Cl.
*B65H 75/44* (2006.01)
*B65H 75/34* (2006.01)
(Continued)

(52) U.S. Cl.
CPC ..... *B65H 75/4486* (2013.01); *B65H 75/34* (2013.01); *B65H 75/4478* (2013.01);
(Continued)

(58) Field of Classification Search
CPC ..... B65H 75/185; B65H 75/30; B65H 75/34; B65H 75/4486
(Continued)

(56) References Cited

U.S. PATENT DOCUMENTS 1,100,140 A * 6/1914 Mayers ..... B60R 22/44 191/12.2 A
2,301,208 A * 11/1942 Gear ..... B65H 75/4407 137/355.2
(Continued)

FOREIGN PATENT DOCUMENTS

JP 07025549 A 1/1995
JP 2012201468 A 10/2012
KR 1020120018504 A 3/2012

OTHER PUBLICATIONS

International Search Report and Written Opinion from PCT Application Serial No. PCT/US2014/042097, dated Oct. 13, 2014, 11 pages.
(Continued)

*Primary Examiner* — John K Fristoe, Jr.
*Assistant Examiner* — Josephine Trinidad-Borges
(74) *Attorney, Agent, or Firm* — Kinney & Lange, P.A.

(57) ABSTRACT

A hose reel includes a hose reel frame, a hose reel spool rotatably mounted on the hose reel frame for rotation about a rotational axis, a drive coupling attached to the hose reel spool and aligned with the rotational axis, a drive mount attached to the hose reel frame, and a drive module mounted on the drive mount that has a drive shaft connected to the drive coupling.

18 Claims, 6 Drawing Sheets

(51) Int. Cl.
*B65H 75/30* (2006.01)
*B65H 75/18* (2006.01)

(52) U.S. Cl.
CPC ..... *B65H 75/4481* (2013.01); *B65H 75/4489* (2013.01); *B65H 75/185* (2013.01); *B65H 75/30* (2013.01); *B65H 2701/33* (2013.01)

(58) Field of Classification Search
USPC ..... 137/355.16, 355.2, 355.21, 355.26, 137/355.27
See application file for complete search history.

(56) References Cited

U.S. PATENT DOCUMENTS 2,496,489 A * 2/1950 Palm ..... B65H 75/4489 137/355.2
2,691,987 A * 10/1954 Snelson ..... A01J 11/00 134/22.1
3,863,038 A * 1/1975 Kreitner ..... F16D 55/40 188/170
4,993,449 A 2/1991 Stutzman et al.
5,211,203 A 5/1993 Vollweiler et al.
5,495,995 A 3/1996 Dominique et al.
5,911,828 A * 6/1999 Curran ..... B05B 9/0403 118/306
6,050,290 A * 4/2000 Yacobi ..... B65H 75/403 137/355.2
2005/0087644 A1 4/2005 Kim
2012/0152373 A1 6/2012 Morgan et al.

OTHER PUBLICATIONS

Extended European Search Report for EP Application No. 14811035.6, dated Jan. 25, 2017, 7 pages.

* cited by examiner

MODULAR DIRECT DRIVE SYSTEM FOR POWERED HOSE REELS

CROSS-REFERENCE TO RELATED APPLICATION

This application claims priority to U.S. Provisional Application No. 61/834,197, filed on Jun. 12, 2013, and entitled "Modular Drive System for Powered Hose Reels," the disclosure of which is incorporated by reference in its entirety.

BACKGROUND

This disclosure relates to hose reels, and more particularly to a modular direct drive system for a hose reel.

Hose reels allow for the compact storage of fluid-carrying hoses. After a hose has been deployed for use, it must be rewound onto the reel for compact storage and to prevent entanglement with the work environment. The rewinding of the hose typically occurs via a hand crank or a drive attached to a chain and sprocket system.

Hose reels are preferably compact because storage area is at a premium in mobile installations and a compact assembly allows for more hose reels and fluid options. In addition, hose reels are preferably powered to eliminate the need for a bulky, manual cranking mechanism. To ensure that the hose reel remains compact, the drive mechanism turns the spool via a chain and sprocket system. The drive is usually housed within the hose reel frame and the chain and sprocket transfers the rotational energy of the drive to the hose reel spool to facilitate rewinding of the hose. Such a system requires maintenance of the chain and sprocket and the installation of safety mechanisms to guard pinch points associated with chain and sprocket systems. A direct drive system eliminates the need for a chain and sprocket, but such systems are usually bulky because they cannot be stored within the hose reel frame, and they do not facilitate easy alteration of various drives to comply with the user's requirements.

SUMMARY

According to one embodiment of the present invention, a hose reel includes a hose reel frame and a hose reel spool that is rotatably mounted on the hose reel frame to allow for rotation about a rotational axis. A drive coupling is attached to the hose reel spool and aligned with the rotational axis. A drive mount is attached to the hose reel frame, and a drive module is mounted on the drive mount. A drive shaft, attached to the drive module, is connected to the drive coupling.

According to another embodiment, a modular hose reel system includes a hose reel frame, a hose reel spool rotatably mounted on the hose reel frame, a drive coupling attached to the hose reel spool along a rotational axis, and a drive mount assembly fastened to the hose reel frame. The drive mount includes a cup and a flange, with the cup having a base, a side wall, and a lip. The flange is integral with the lip of the cup and extends partially around the cup. The cup and the flange are adapted to retain a mounting plate portion of an interchangeable direct drive module.

DETAILED DESCRIPTION

Figure 1:
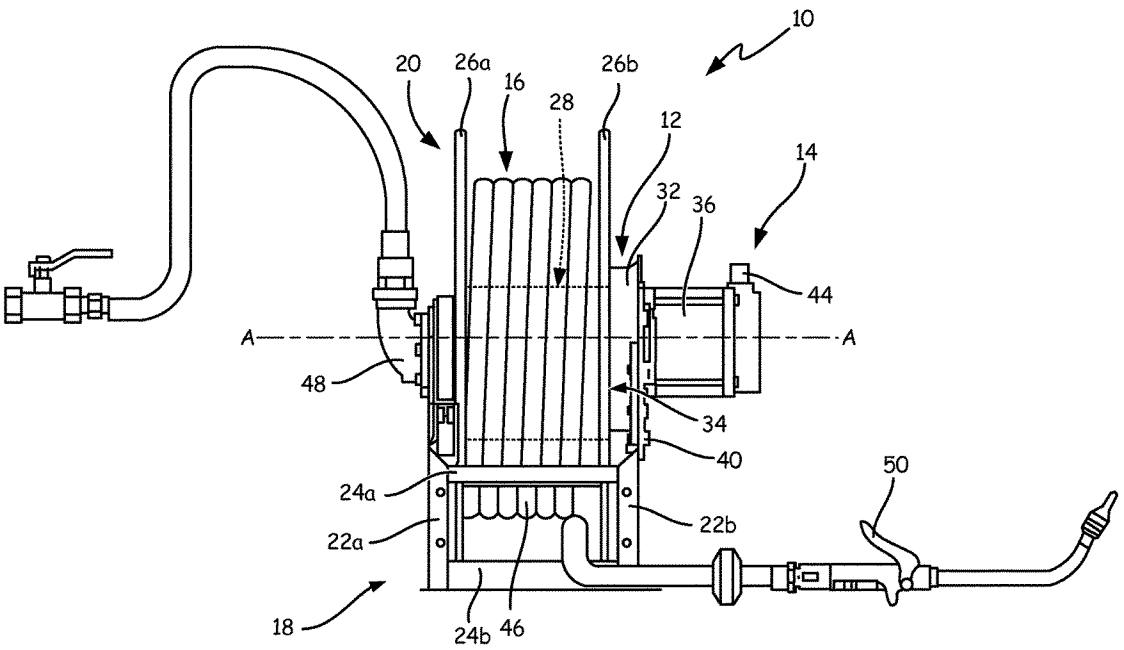
FIG. 1 is a front view of a hose reel assembly, a hose, and a drive module.

FIG. 1 is a front view of hose reel assembly 10, drive mount 12, drive module 14, and hose assembly 16. Hose reel assembly 10 includes hose reel frame 18 and hose reel spool 20. Hose reel frame 18 includes frame side walls 22*a* and 22*b* and frame support beams 24*a* and 24*b*. Hose reel spool 20 includes spool side walls 26*a* and 26*b*, axial hub 28, and aperture 30 (shown in FIGS. 2 and 4).

Figure 2:
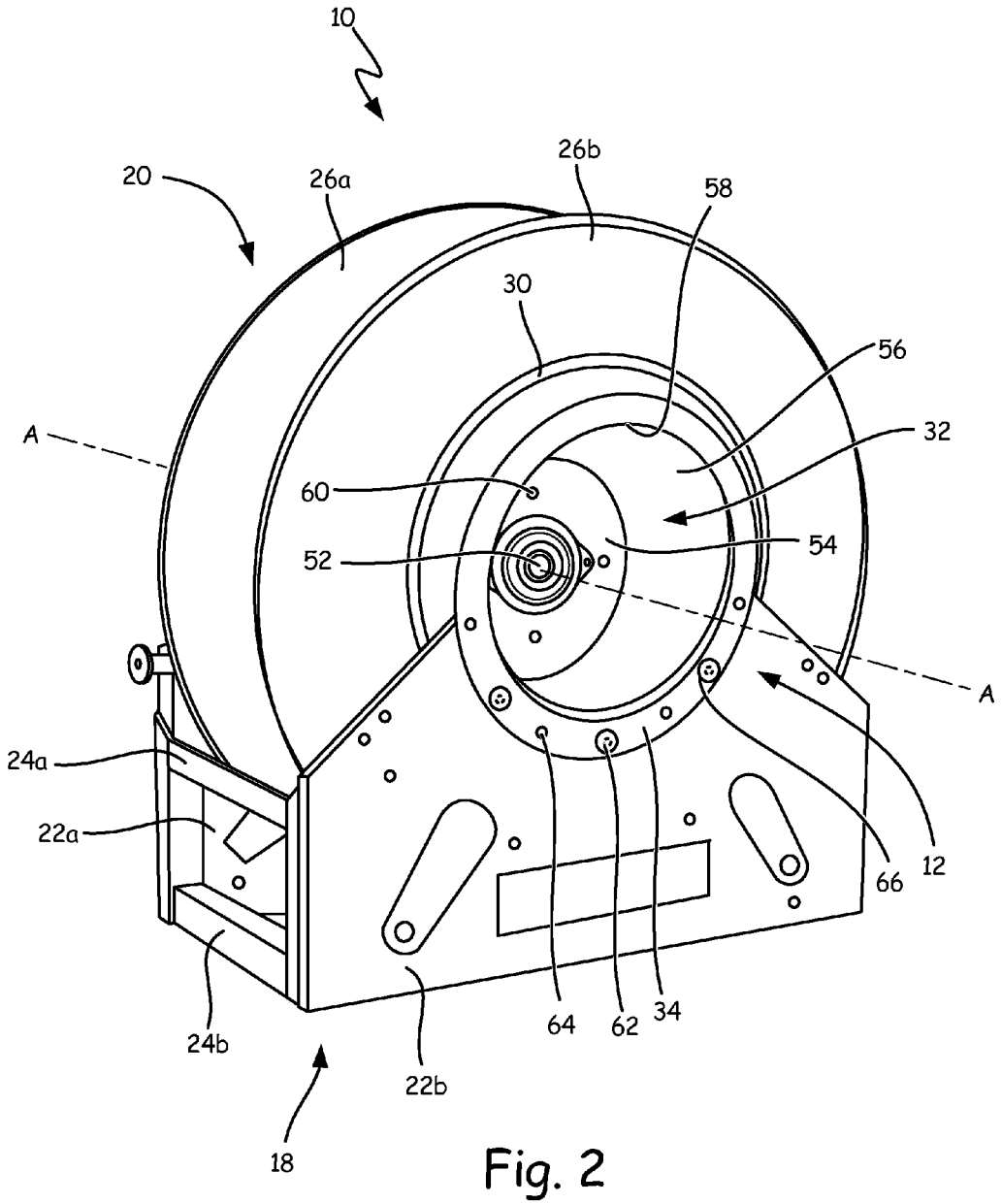
FIG. 2 is a perspective view showing a hose reel frame, a hose reel spool, and a drive coupling.

Drive mount 12 includes cup 32 and flange 34 (best seen in FIG. 2). Drive module 14 is an interchangeable drive module, and in this example embodiment, drive module 14 is an electric drive module that includes electric motor 36, gear reduction drive 38 (FIG. 3), mounting plate 40, drive shaft 42 (FIG. 3), and power supply port 44 (electric drive module is shown further in FIGS. 3 and 4).

Hose assembly 16 includes hose 46, fluid inlet 48 for allowing fluid to enter hose assembly 16, and dispensing valve 50 for dispensing fluid from hose 46. In FIG. 1, hose 46 is shown in a spooled position within hose reel spool 20.

Hose reel spool 20 is mounted such that it rotates about rotational axis A-A. Hose reel spool 20 is rotatably mounted on frame side walls 22*a* and 22*b* and can be supported by roller bearings, bushings, or any other suitable support mechanism. Drive mount 12 is affixed to hose reel frame 18 by securing flange 34 to frame side wall 22*b*. When flange 34 is secured to frame side wall 22*b*, cup 32 extends into aperture 30 (FIGS. 2 and 4) of spool side wall 26*b*. Drive module 14 can then be secured to drive mount 12 by affixing mounting plate 40 to flange 34. In this example embodiment, when drive module 14 is mounted on drive mount 12, gear reduction drive 38 (FIG. 3) is housed within cup 32.

FIG. 2 is a perspective view of hose reel assembly 10 and drive mount 12, with drive coupling 52. Drive mount includes cup 32 and flange 34. Cup 32 includes base 54, side wall 56, lip 58, and mounting holes 60 in base 54. Flange 34 is integral with lip 58, and includes attachment points 62 and mounting holes 64.

Drive coupling 52 is shown as a splined female coupling, but drive coupling 52 can be square, triangular, or any other suitable coupling shape for engaging drive shaft 42. Drive coupling 52 is fixedly attached to axial hub 28 along rotational axis A-A. Hose reel spool 20 is rotatably mounted on frame side walls 22*a* and 22*b* and supported by roller bearings, bushings, or any other suitable support mechanism. Hose reel spool 20 is mounted such that it rotates about rotational axis A-A. Aperture 30 then extends through spool side wall 26*b* and into axial hub 28.

Drive mount 12 can be secured to hose reel frame 18 by inserting fasteners 66 through attachment points 62 of flange 34 and into frame side wall 22*b*. When drive mount 12 is secured to hose reel frame 18, cup 32 extends into aperture 30. Drive coupling 52 then extends through base 54 and into cup 32.

Drive mount 12 allows for drive shaft 42 to directly engage drive coupling 52 for rewinding hose 46 onto hose reel spool 20. Cup 32 houses drive module 14 to minimize any increase to the width of hose reel assembly 10 when compared to past direct drive systems. When drive module 14 is activated, the rotational energy of drive module 14 is transferred to hose reel spool 20 by drive shaft 42 and drive coupling 52, which rewinds hose 46 onto hose reel spool 20.

Figure 3:
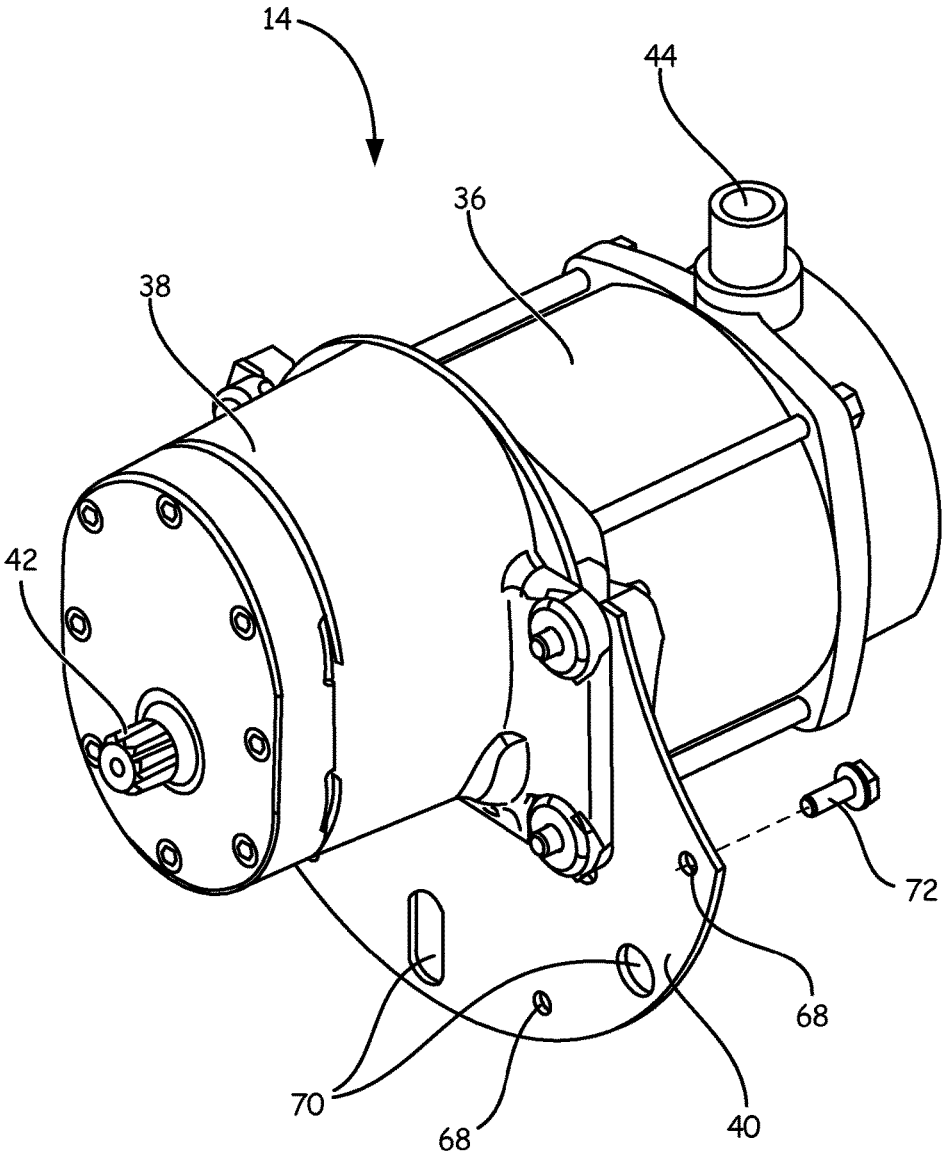
FIG. 3 is a perspective view of an electric drive module.

FIG. 3 is a perspective view of one example embodiment of drive module 14. In this example embodiment, drive module 14 is an electric drive module, which includes electric motor 36, gear reduction drive 38, mounting plate 40, drive shaft 42, and power supply port 44. Mounting plate 40 includes mounting holes 68 and receiving holes 70. Drive shaft 42 is shown as a splined shaft, but drive shaft 42 can be square, triangular, or any other suitable shape for engaging drive coupling 52.

Mounting plate 40 can be retained between electric motor 36 and gear reduction drive 38 by screws, bolts, or any other suitable fasteners. Drive module 14 is mounted to drive mount 12 by securing mounting plate 40 to flange 34 with fasteners 72 that extend through mounting holes 68 of mounting plate 40 and mounting holes 64 of flange 34. Electric motor 36 engages gear reduction drive 38 to turn drive shaft 42. Gear reduction drive 38 reduces the speed and increases the torque with which drive shaft 42 turns. Drive shaft 42 directly engages drive coupling 52 to rotate hose reel spool 20 and rewind hose 46 onto hose reel spool 20. Alternatively, electric motor 36 can include an electric low revolutions per minute (rpm), high torque direct drive motor, such as a "pancake" motor, housed within cup 32.

Figure 4:
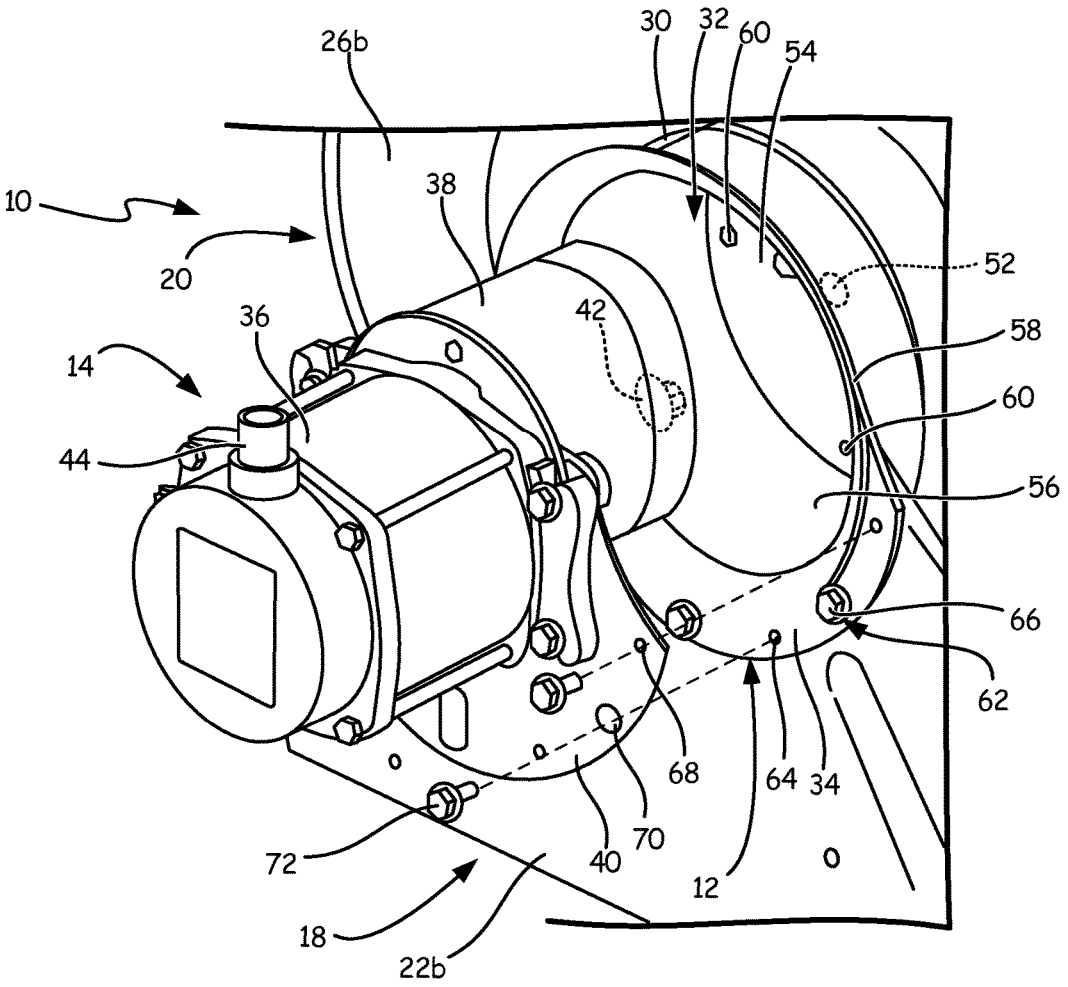
FIG. 4 is an exploded perspective view of the hose reel frame, hose reel spool, the electric drive module of FIG. 3, and a drive mount.

FIG. 4 is an exploded perspective view of hose reel assembly 10, drive mount 12, and drive module 14. Drive mount 12 includes cup 32 and flange 34. Cup 32 has base 54, side wall 56, lip 58, and mounting holes 60. Flange 34 is integral with lip 58 of cup 32. Flange 34 includes attachment points 62 and mounting holes 64. In certain embodiments, drive module 14 is an electric drive module, which has electric motor 36, gear reduction drive 38, mounting plate 40, drive shaft 42, and power supply port 44. Mounting plate 40 includes mounting holes 68 and receiving holes 70.

Drive mount 12 is secured to hose reel frame 18 by inserting fasteners 66 through attachment points 62 of flange 34 and into frame side wall **22*b*. When drive mount 12 is secured to hose reel frame 18, cup 32 extends into aperture 30 and drive coupling 52 extends through base 54 and into cup 32. Mounting plate 40 is secured to flange 34 by fasteners 72 that extend through mounting holes 68 in mounting plate 40 and mounting holes 64 in flange 34. Receiving holes 70 allow fasteners 66 used to secure flange 34 to frame sidewall 22*b* to extend through mounting plate 40, such that mounting plate 40 lies flush against flange 34**.

When mounting plate 40 is secured to flange 34, gear reduction drive 38 is housed within cup 32 and electric motor 36 is directly adjacent to cup 32. Drive shaft 42 directly engages drive coupling 52. Housing gear reduction drive 38 within cup 32 causes drive module 14 to minimally increase the overall width of hose reel assembly 10, still less than past direct drive arrangements.

Figure 5:
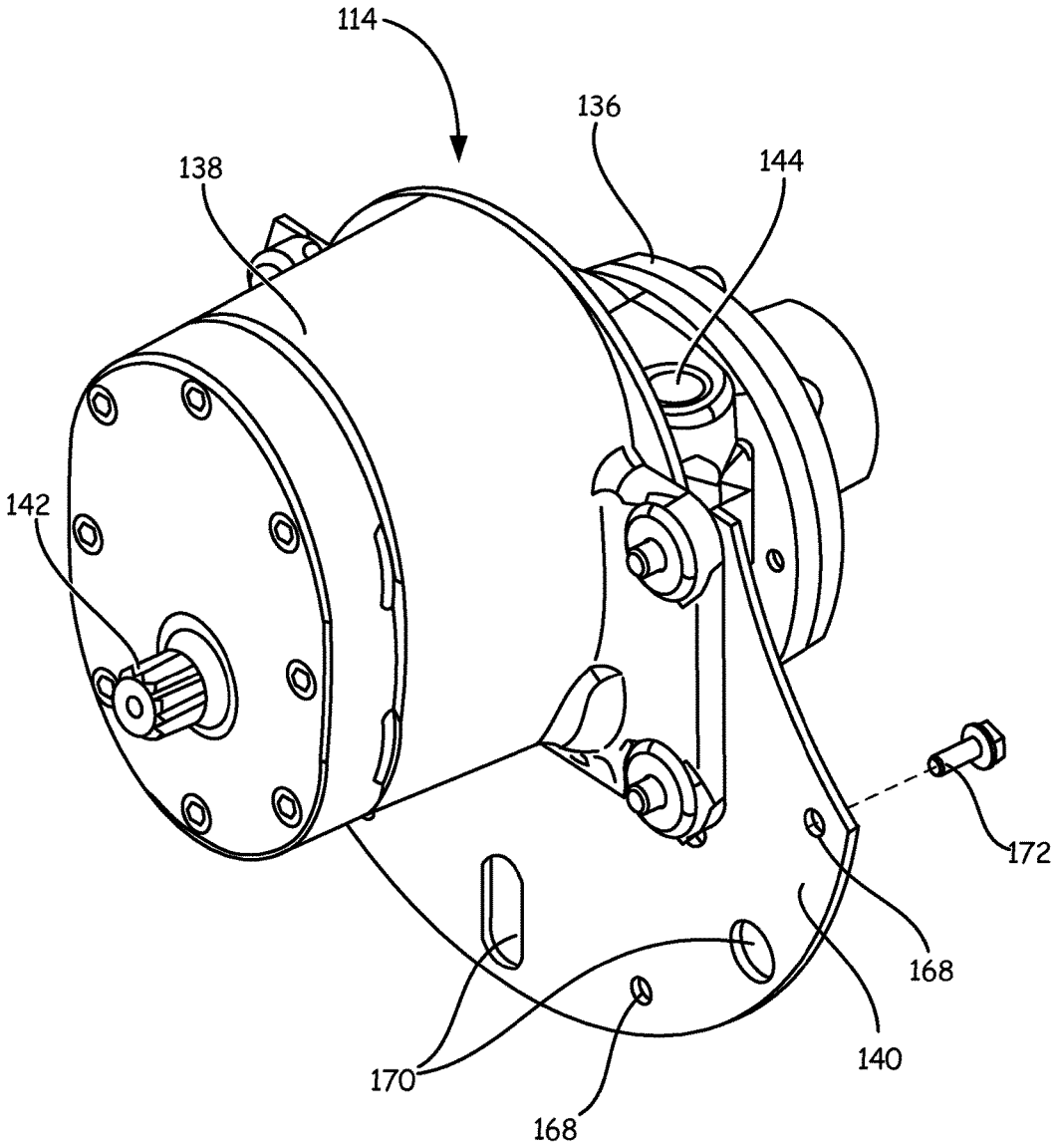
FIG. 5 shows a pneumatic drive module.

FIG. 5 is a perspective view of a second example embodiment of a drive module. In this illustrative embodiment, drive module 114 is a pneumatic drive module, which includes pneumatic motor 136, gear reduction drive 138, mounting plate 140, drive shaft 142, and air inlet 144. Drive module 114 can take the place of electric drive module 14 shown in FIGS. 3 and 4. Here, mounting plate 140 is substantially similar as mounting plate 40 (shown in FIGS. 3 and 4), and includes mounting holes 168 and receiving holes 170. Like mounting plate 40, mounting plate 140 can be secured between pneumatic motor 136 and gear reduction drive 138 by screws, bolts, or any other suitable fasteners. Drive shaft 142 is substantially similar to drive shaft 42, and is shown as a splined shaft, but drive shaft 142 can be square, triangular, or any other suitable shape for engaging drive coupling 52.

Similar to the example shown in FIG. 4, pneumatic drive module 114 is secured to drive mount 12. Fasteners 172 extend through mounting holes 168 of mounting plate 140 and into mounting holes 64 of flange 34. Receiving holes 170 allow fasteners 66 used to secure flange 34 to frame sidewall **22*b* to extend through mounting plate 140, such that mounting plate 140 lies flush against flange 34**.

When mounting plate 140 is secured to flange 34, gear reduction drive 138 is housed within cup 32 and pneumatic motor 136 is directly adjacent to, and extends outside of, cup 32. Drive shaft 142 directly engages drive coupling 52. Housing gear reduction drive 138 within cup 32 provides for a minimal increase to the overall width of hose reel assembly 10. When drive module 14 is activated, the rotational energy of pneumatic motor 136 is transferred to drive shaft 142 by gear reduction drive 138. Drive shaft 142 rotates drive coupling 52 to rewind hose 46 onto hose reel spool 20. Though shown with gear reduction drive 138, pneumatic motor 136 can alternatively be a pneumatic low speed, high torque motor that is fully housed within cup 38, eliminating the need for gear reduction drive 138.

Figure 6:
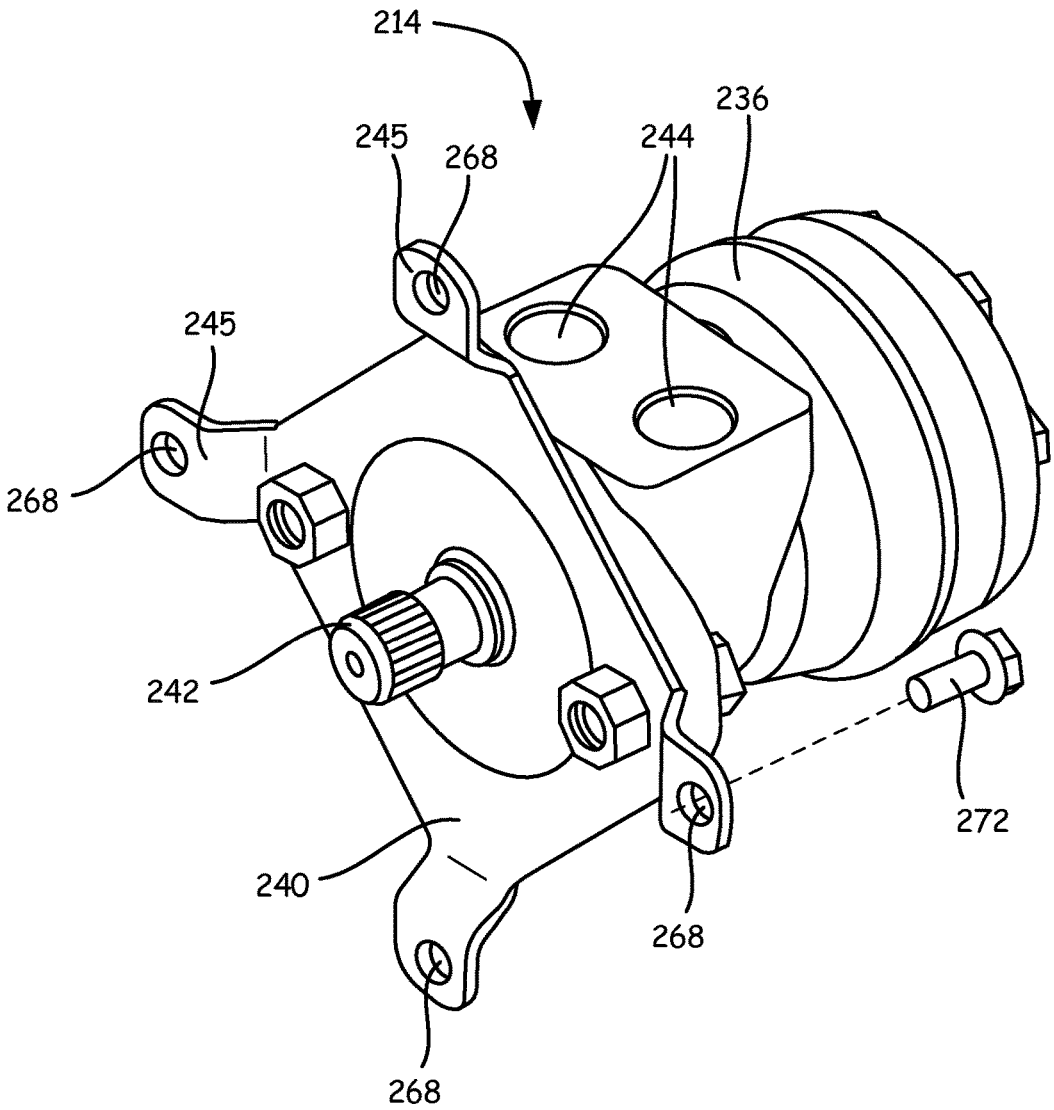
FIG. 6 depicts a hydraulic drive module.

FIG. 6 is a perspective view of a third embodiment of a drive module. In this alternative embodiment, drive module 214 is a hydraulic drive module, which includes hydraulic motor 236, mounting plate 240, drive shaft 242, and fluid ports 244. Mounting plate 240 includes a plurality of arms 245, with each of the plurality of arms 245 having mounting hole 268. Drive shaft 242 is substantially similar to drive shaft 42, and is shown as a splined shaft, but drive shaft 242 can be square, triangular, or any other suitable shape for engaging a drive coupling.

Again, similar to FIGS. 3-5, hydraulic drive module 214 can be attached within cup 32 of drive mount 12 by fasteners 272 that extend through mounting holes 268 in each of plurality of arms 245 and mounting holes 60 in base 54 of cup 32. When mounting plate 240 is secured to cup 32, hydraulic drive module 214 is housed within cup 32. Housing drive module 14 within cup 32 protects hydraulic drive module 214 from environmental damage, and ensures that this alternate embodiment does not alter the overall width of hose reel assembly 10 because drive module 14 is fully housed within cup 32.

When mounting plate 240 is secured to cup 32, drive shaft 242 directly engages drive coupling 52. To rewind hose 46 onto hose reel spool 20, hydraulic motor 236 is activated and the rotational energy of hydraulic motor 236 is transferred to drive shaft 242, which rotates drive coupling 52 and rewinds hose 46 onto hose reel spool 20.

A directly coupled hydraulic drive module allows for easier hose extension in cold-weather environments. In a typical hydraulic chain gear reduction drive, the hydraulic motor rotates about sixteen times for every rotation of hose reel spool 20. This prevents easy hose extension because of resistance from hydraulic motor 236 and recirculation of cold hydraulic fluid. A 1:1 drive ratio enables easier hose extension due to a higher torque available to rotate the motor against the cold hydraulic fluid.

The modular direct drive system described herein provides several advantages. Space is at a premium on mobile lube operations and a narrow width allows the user to stock a greater number of hose reel assembly 10 and offer more fluid options. Housing drive module 14 partially or fully within drive mount 12 ensures minimal increase to the width of hose reel assembly 10. The direct drive nature of drive module 14 is completely enclosed, which gives a longer unit life without the need for lubrication maintenance. In addition, the direct coupling of drive shaft 42 and drive coupling 52 eliminates an exposed chain and sprocket system, significantly reducing the chance of user injury due to moving parts. Constructing drive mount 12 to accept mounting plate 40 or mounting plate 240 allows for easy interchange between the various embodiments of drive module 14 to suit the user's needs. This interchangeability allows distributors to carry lower inventory costs and provide a larger product offering by stocking an unpowered hose reel assembly 10 that can accept any embodiment of drive module 14. In addition, drive interchangeability provides lower end-user costs because the end user may purchase a single hose reel assembly 10 to be powered by any embodiment of drive module 14 instead of purchasing three separate assemblies powered by the three various drive module 14 embodiments.

Although the present invention has been described with reference to preferred embodiments, workers skilled in the art will recognize that changes may be made in form and detail without departing from the spirit and scope of the invention.

The invention claimed is:

1. A hose reel assembly comprising:
- a hose reel frame;
- a hose reel spool rotatably mounted on the hose reel frame for rotation about a rotational axis, the hose reel spool comprising:
  - a hub connecting a first side wall and a second side wall; and
  - an aperture extending through the second side wall and into the hub;
- a drive coupling attached to the hose reel spool and aligned with the rotational axis;
- a drive mount attached to the hose reel frame, the drive mount comprising:
  - a cup having a closed end that extends into the aperture of the hose reel spool; and
- a drive module secured to the drive mount and having a drive shaft rotatably connected to the drive coupling, the drive module comprising:
  - a motor module; and
  - a mounting plate fixedly attached to the motor module, wherein the mounting plate includes a plurality of arms secured to the closed end;
- wherein the drive shaft extends through the mounting plate and the mounting plate is secured within the cup.

2. The hose reel assembly of claim 1, wherein the drive mount comprises:
- a flange partially extending around an open end of the cup; and
- wherein the flange is fixedly attached to the hose reel frame.

3. The hose reel assembly of claim 1, wherein the motor module is a hydraulic motor.

4. The hose reel assembly of claim 1, wherein the motor module is an electric motor.

5. The hose reel assembly of claim 1, wherein the motor module is a pneumatic motor.

6. The hose reel assembly of claim 1, further comprising:
- a gear reduction drive;
- wherein the mounting plate is secured between the motor module and the gear reduction drive.

7. The hose reel assembly of claim 6, wherein the motor is an electric motor.

8. The hose reel assembly of claim 6, wherein the motor is a pneumatic motor.

9. The hose reel assembly of claim 1, wherein the drive shaft includes a male splined shaft and the drive coupling includes a female splined coupling.

10. A modular hose reel system comprising:
- a hose reel frame;
- a hose reel spool rotatably mounted on the hose reel frame, the hose reel spool including a hub connecting a first side wall and a second side wall, and an aperture extending through the second side wall and into the hub;
- a drive coupling attached to the hose reel spool along a rotational axis; and
- a drive mount assembly comprising:
  - a cup disposed within the aperture, and having a base, a side wall extending from the base, and a lip;
  - a flange integral with the lip and extending partially around the cup; and
  - attachment points extending through the flange, wherein the flange is attached to the hose reel frame at the attachment points and adapted to directly connect to and support a stationary mounting plate portion of an interchangeable direct drive module.

11. The system of claim 10, wherein the mounting plate is fastened to the base of the drive mount assembly and the interchangeable direct drive module is disposed within the cup of the drive mount assembly.

12. The system of claim 10, wherein the mounting plate is fastened to the flange of the drive mount assembly.

13. The system of claim 12, wherein the mounting plate further comprises a set of receiving holes, the flange is attached to the hose reel frame with a first set of fasteners, and the first set of fasteners protrude through the receiving holes.

14. The system of claim 10, wherein the interchangeable direct drive module includes a drive motor selected from a group consisting of: an electric motor, a pneumatic motor, and a hydraulic motor.

15. The system of claim 14, wherein the drive motor is connectable to the drive coupling through a gear reduction drive attached to the drive motor.

16. The system of claim 14, wherein the drive motor is directly connectable to the drive coupling.

17. A modular reel system comprising:
- a hose reel frame;
- a hose reel spool rotatably mounted on the hose reel frame, the hose reel spool including a hub connecting a first side wall and a second side wall, and an aperture extending through the second side wall and into the hub;
- a drive coupling attached to the hose reel spool along a rotational axis; and
- a drive mount assembly comprising:
  - a cup disposed within the aperture, and having a base, a side wall extending from the base, and a lip; and
  - a flange integral with the lip and extending partially around the cup;
  - wherein a stationary mounting plate of an interchangeable direct drive module is directly fastened to one of the base and the flange.

18. The modular reel system of claim 17, wherein the interchangeable direct drive module is at least partially disposed within the cup with the mounting plate directly fastened to one of the base and the flange.

* * * * *